US009630216B1

(12) United States Patent
Preston

(10) Patent No.: US 9,630,216 B1
(45) Date of Patent: Apr. 25, 2017

(54) TICKET SCRAPING DEVICE

(71) Applicant: Mimie Preston, Waldorf, MD (US)

(72) Inventor: Mimie Preston, Waldorf, MD (US)

( * ) Notice: Subject to any disclaimer, the term of this patent is extended or adjusted under 35 U.S.C. 154(b) by 0 days.

(21) Appl. No.: 15/049,131

(22) Filed: Feb. 21, 2016

(51) Int. Cl.
*A47L 13/02* (2006.01)
*A63F 3/06* (2006.01)
*B08B 1/00* (2006.01)

(52) U.S. Cl.
CPC ..... *B08B 1/005* (2013.01); *A47L 13/02* (2013.01); *A63F 3/068* (2013.01)

(58) Field of Classification Search
CPC ..... A47L 13/02; A63F 3/068
See application file for complete search history.

(56) References Cited

U.S. PATENT DOCUMENTS 4,765,842 A 8/1988 Sanders et al.
5,253,383 A * 10/1993 Clark ..... A63F 3/068 15/34
5,355,543 A 10/1994 Cameron et al.
5,402,549 A 4/1995 Forrest
5,419,004 A * 5/1995 Fox ..... A63F 3/068 15/104.8
5,577,287 A 11/1996 Olson
D379,255 S 5/1997 Steiner
5,907,882 A 6/1999 Tyree
7,607,193 B1 10/2009 Franklin
8,191,195 B2 6/2012 Nelson
9,044,787 B1 * 6/2015 Stewart ..... B08B 1/002

* cited by examiner

*Primary Examiner* — Randall Chin

(57) ABSTRACT

A ticket scraping device for scraping an obscurant layer off of a ticket includes a housing that is substantially rectangularly box shaped. A first slot is centrally positioned in a top of the housing. The first slot is sized such that an end of a ticket is insertable into the first slot. A second slot is complementary to the first slot and is positioned in a front of the housing. A wall extends from a perimeter of the first slot to a rim of the second slot, defining a channel that extends from the first slot to the second slot. A scraper is coupled to the wall and extends into the channel. The first slot is configured for insertion of the ticket and the scraper is configured to remove an obscurant layer from the ticket as the ticket is directed past the scraper to the second slot.

18 Claims, 4 Drawing Sheets

TICKET SCRAPING DEVICE

BACKGROUND OF THE DISCLOSURE

Field of the Disclosure

The disclosure relates to scraping devices and more particularly pertains to a new scraping device for scraping an obscurant layer off of a ticket.

SUMMARY OF THE DISCLOSURE

An embodiment of the disclosure meets the needs presented above by generally comprising a housing that is substantially rectangularly box shaped. A first slot is centrally positioned in a top of the housing. The first slot is sized such that an end of a ticket is insertable into the first slot. A second slot is complementary to the first slot and is positioned in a front of the housing. A wall extends from a perimeter of the first slot to a rim of the second slot, defining a channel that extends from the first slot to the second slot. A scraper is coupled to the wall and extends into the channel. The first slot is configured for insertion of the ticket and the scraper is configured to remove an obscurant layer from the ticket as the ticket is directed past the scraper to the second slot.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
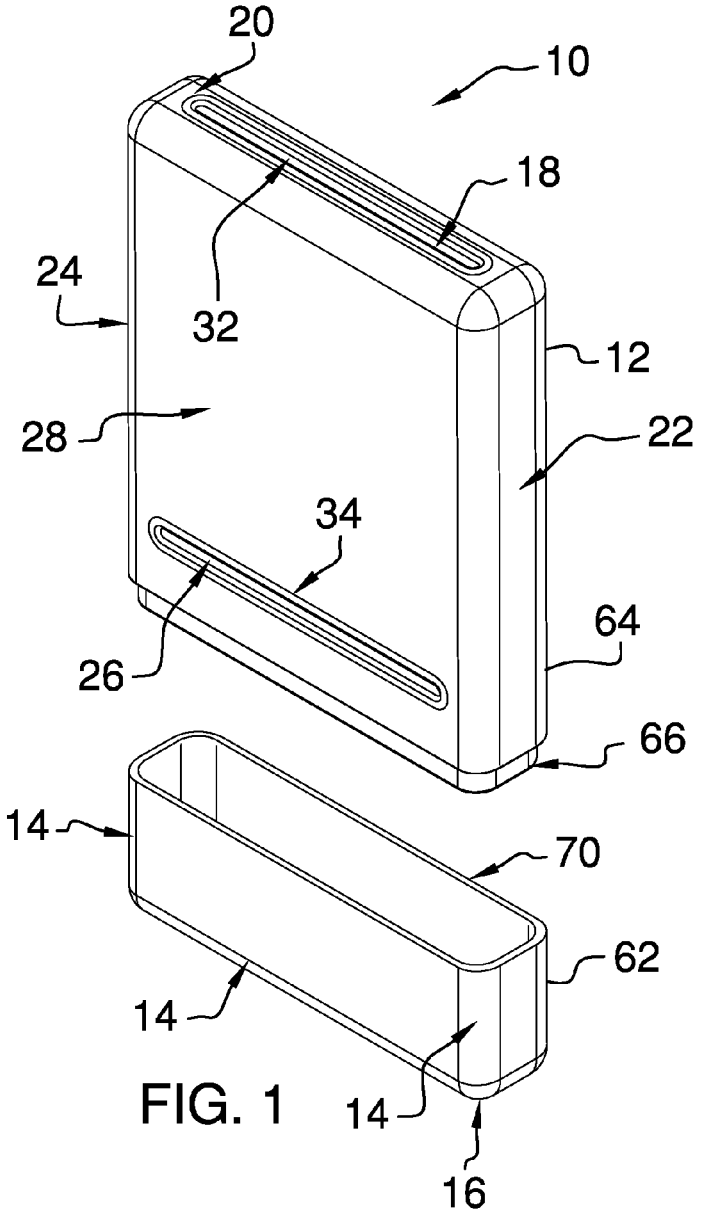
FIG. 1 is an isometric perspective view of a ticket scraping device according to an embodiment of the disclosure.
Figure 2:
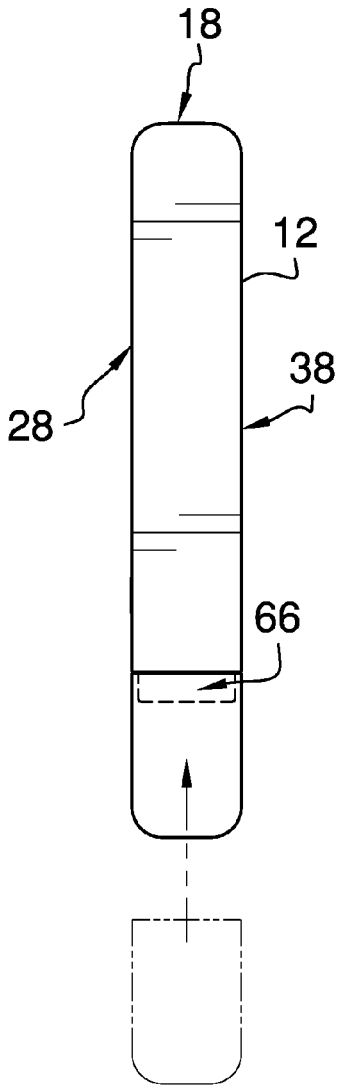
FIG. 2 is a side view of an embodiment of the disclosure.
Figure 3:
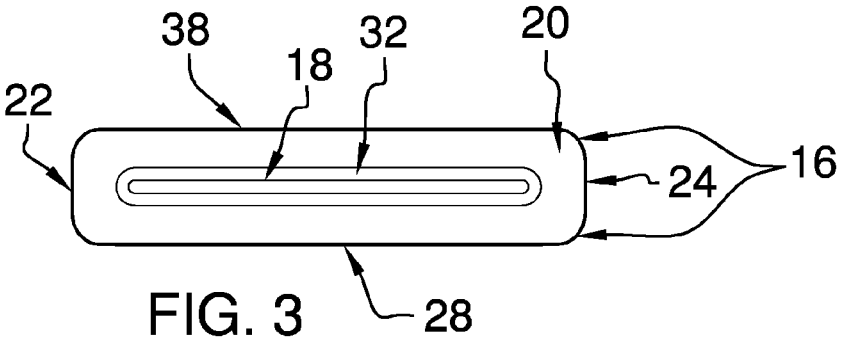
FIG. 3 is a top view of an embodiment of the disclosure.
Figure 4:
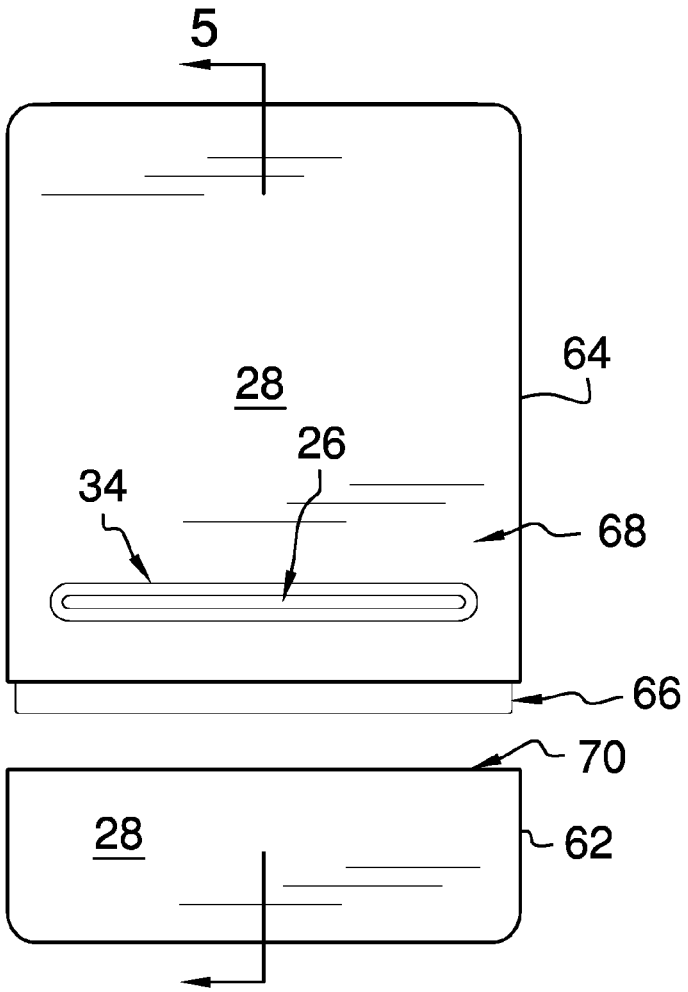
FIG. 4 is a front view of an embodiment of the disclosure.
Figure 5:
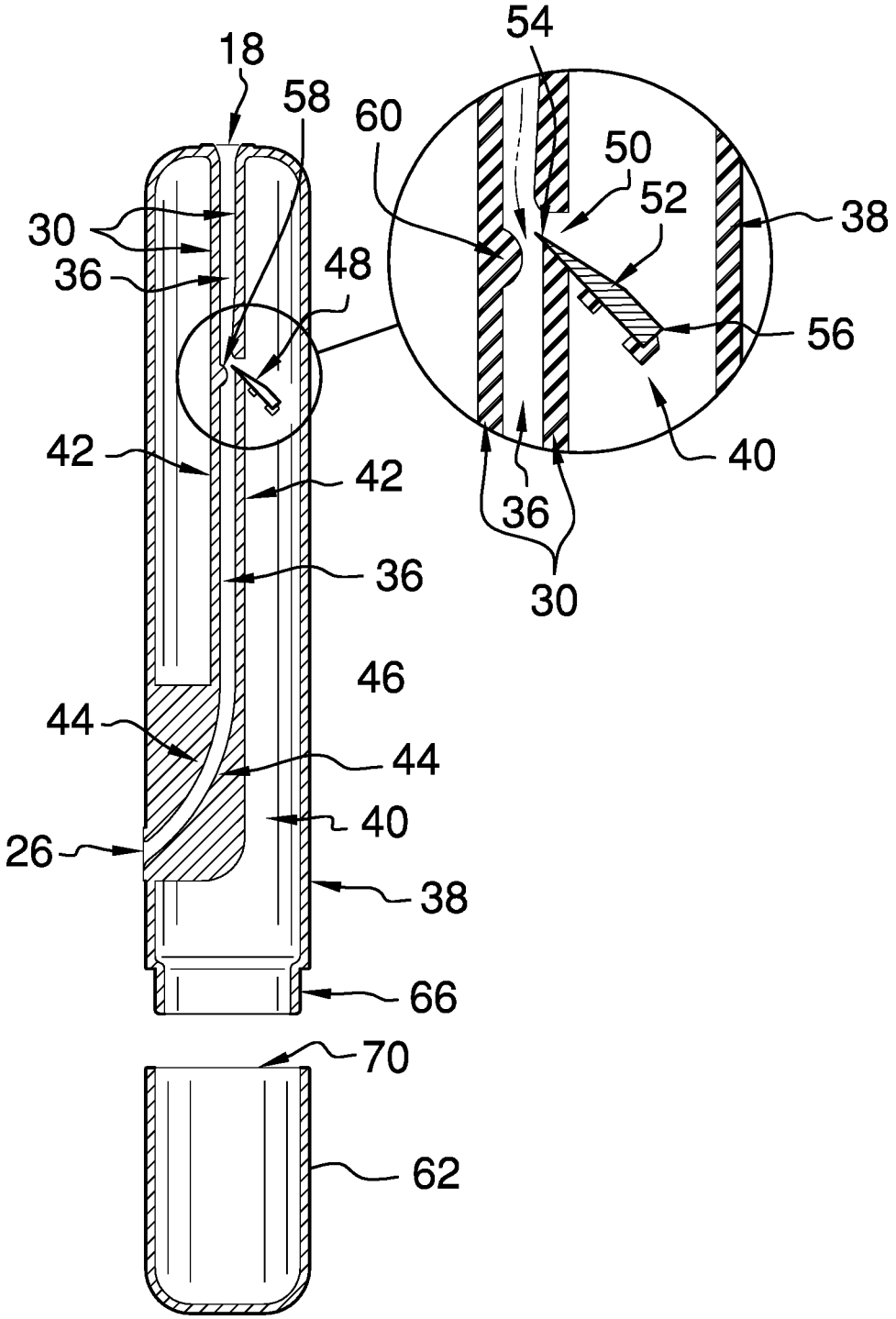
FIG. 5 is a cross-sectional view of an embodiment of the disclosure.
Figure 6:
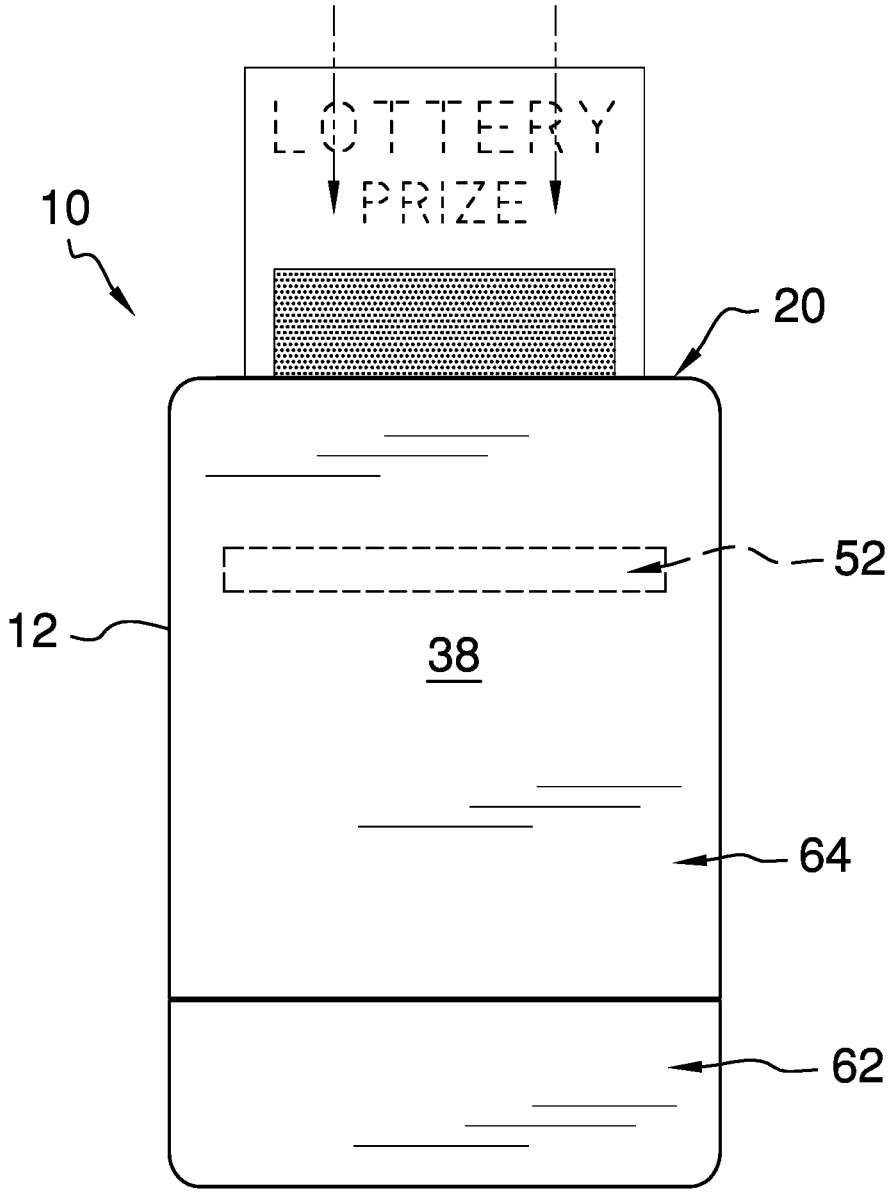
FIG. 6 is an in-use view of an embodiment of the disclosure.

With reference now to the drawings, and in particular to FIGS. 1 through 6 thereof, a new scraping device embodying the principles and concepts of an embodiment of the disclosure and generally designated by the reference numeral 10 will be described.

As best illustrated in FIGS. 1 through 6, the ticket scraping device 10 generally comprises a housing 12 that is substantially rectangularly box shaped. The housing 12 has intersecting edges 14 and corners 16. Preferably, the intersecting edges 14 and the corners 16 are rounded.

A first slot 18 is centrally positioned in a top 20 of the housing 12. The first slot 18 is sized such that an end of a ticket is insertable into the first slot 18. The first slot 18 extends from proximate to a first side 22 of the housing 12 to proximate to a second side 24 of the housing 12. A second slot 26, which is complementary to the first slot 18, is positioned in a front 28 of the housing 12. The second slot 26 extends from proximate to the first side 22 of the housing 12 to proximate to the second side 24 of the housing 12.

A wall 30 extends from a perimeter 32 of the first slot 18 to a rim 34 of the second slot 26, defining a channel 36 that extends from the first slot 18 to the second slot 26. The wall 30 and a back 38 of the housing 12 define a chamber 40. The wall 30 comprises a first section 42 and a second section 44. The first section 42 extends perpendicularly from the top 20 of the housing 12, such that the first section 42 and the front 28 of the housing 12 are substantially parallel. The second section 44 extends curvedly from a lower limit 46 of the first section 42 to the front 28 of the housing 12, such that a ticket inserted through the first slot 18 is directed to the second slot 26.

A scraper 48 is coupled to the wall 30 and extends into the channel 36. A third slot 50 is positioned in the wall 30 and connects the channel 36 to the chamber 40. The third slot 50 is complementary to the scraper 48. The third slot 50 extends from proximate to the first side 22 of the housing 12 to proximate to the second side 24 of the housing 12. Preferably, the scraper 48 comprises a blade 52. The blade 52 is coupled to the wall 30 such that a cutting edge 54 of the blade 52 extends through the third slot 50 into the channel 36. The blade 52 extends from proximate to the first side 22 of the housing 12 to proximate to the second side 24 of the housing 12. The blade 52 is transverse to the wall 30, such that a blunt end 56 of the blade 52 is positioned in the chamber 40 below the third slot 50. An obscurant layer removed from a ticket contacting the blade 52 is directed into the chamber 40.

A biaser 58 is positioned in the channel 36 and coupled to the wall 30 substantially opposite the third slot 50. The biaser 58 is positioned on the wall 30 such that a ticket that is positioned through the channel 36 is brought into sliding contact with the scraper 48. The biaser 58 extends from proximate to the first side 22 of the housing 12 to proximate to the second side 24 of the housing 12. Preferably, the biaser 58 comprises a protrusion 60 that is coupled to the wall 30 substantially opposite the third slot 50. Also preferably, the protrusion 60 is rounded.

The housing 12 comprises a lower portion 62 and an upper portion 64. The lower portion 62 is positioned below the second slot 26 and is separable from the upper portion 64. The lower portion 62 is configured to collect debris entering the chamber 40. The lower portion 62 is separable from the upper portion 64 such that the debris may be removed from the housing 12. Preferably, the upper portion 64 has a lower lip 66 that is recessed relative to an exterior 68 of the housing 12. The lower portion 62 has an upper end 70 that is open and complementary to the lip 66. The lip 66 is positioned for insertion into the upper end 70, such that the lower portion 62 is reversibly couplable to the upper portion 64.

In use, the first slot 18 is configured for insertion of a ticket. The biaser 58 is positioned to urge the ticket to contact the scraper 48, which is configured to remove an obscurant layer from the ticket as the ticket is directed past the scraper 48 to the second slot 26. Obscurant layer removed from the ticket is directed to the chamber 40 and collects in the lower portion 62 of the housing 12. The lower portion 62 is separable from the upper portion 64 for removal of debris from the housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ticket scraping device comprising:

a housing, said housing being substantially rectangularly box shaped;

a first slot, said first slot being centrally positioned in a top of said housing, said first slot being sized such that an end of a ticket is insertable into said first slot;

a second slot, said second slot being complementary to said first slot, said second slot being positioned in a front of said housing;

a wall, said wall extending from a perimeter of said first slot to a rim of said second slot, defining a channel extending from said first slot to said second slot;

a scraper, said scraper being coupled to said wall and extending into said channel; and wherein said first slot is configured for insertion of a ticket, wherein said scraper is configured to remove an obscurant layer from the ticket as the ticket is directed past said scraper to said second slot.

2. The device of claim 1, further including said housing having intersecting edges and corners, said intersecting edges and said corners being rounded.

3. The device of claim 1, further including said first slot and said second slot extending from proximate to a first side of said housing to proximate to a second side of said housing.

4. The device of claim 1, further including said wall and a back of said housing defining a chamber.

5. The device of claim 4, further including a third slot, said third slot being positioned in said wall and connecting said channel to said chamber, said third slot being complementary to said scraper.

6. The device of claim 5, further including said third slot extending from proximate to said first side of said housing to proximate to said second side of said housing.

7. The device of claim 6, further including said scraper comprising a blade.

8. The device of claim 7, further including said blade being coupled to said wall such that a cutting edge of said blade extends through said third slot into said channel.

9. The device of claim 8, further including said blade extending from proximate to said first side of said housing to proximate to said second side of said housing.

10. The device of claim 9, further including said blade being transverse to said wall, wherein a blunt end of said blade is positioned in said chamber below said third slot, such that an obscurant layer removed from a ticket contacting said blade is directed into said chamber.

11. The device of claim 10, further including said housing comprising a lower portion and an upper portion, said lower portion being positioned below said second slot, said lower portion being separable from said upper portion, wherein said lower portion is configured to collect debris entering said chamber and wherein said lower portion is separable from said upper portion such that the debris may be removed from said housing.

12. The device of claim 11, further including said upper portion having a lower lip, said lower lip being recessed relative to an exterior of said housing, said lower portion having a upper end, said upper end being open, said upper end being complementary to said lip, wherein said lip is positioned for insertion into said upper end, such that said lower portion is reversibly couplable to said upper portion.

13. The device of claim 9, further including a biaser, said biaser being positioned in said channel and coupled to said wall substantially opposite said third slot, wherein said biaser is positioned on said wall such that a ticket being positioned through said channel is brought into sliding contact with said scraper.

14. The device of claim 13, further including said biaser extending from proximate to said first side of said housing to proximate to said second side of said housing.

15. The device of claim 14, further including said biaser comprising a protrusion, said protrusion being coupled to said wall substantially opposite said third slot.

16. The device of claim 15, further including said protrusion being rounded.

17. The device of claim 1, further including said wall comprising:

a first section, said first section extending perpendicularly from said top of said housing, such that said first section and said front of said housing are substantially parallel; and a second section, said second section extending curvedly from a lower limit of said first section to said front of said housing, wherein a ticket inserted through said first slot is directed to said second slot.

18. A ticket scraping device comprising:

a housing, said housing being substantially rectangularly box shaped, said housing having intersecting edges and corners, said intersecting edges and said corners being rounded;

a first slot, said first slot being centrally positioned in a top of said housing, said first slot being sized such that an end of a ticket is insertable into said first slot, said first slot extending from proximate to a first side of said housing to proximate to a second side of said housing;

a second slot, said second slot being complementary to said first slot, said second slot being positioned in a front of said housing, said second slot extending from proximate to said first side of said housing to proximate to said second side of said housing;

a wall, said wall extending from a perimeter of said first slot to a rim of said second slot, defining a channel extending from said first slot to said second slot, said wall and a back of said housing defining a chamber, said wall comprising a first section and a second section, said first section extending perpendicularly from said top of said housing, such that said first section and said front of said housing are substantially parallel, said second section extending curvedly from a lower limit of said first section to said front of said housing, wherein a ticket inserted through said first slot is directed to said second slot;

a scraper, said scraper being coupled to said wall and extending into said channel;

a third slot, said third slot being positioned in said wall and connecting said channel to said chamber, said third slot being complementary to said scraper, said third slot extending from proximate to said first side of said housing to proximate to said second side of said housing;

said scraper comprising a blade, said blade being coupled to said wall such that a cutting edge of said blade extends through said third slot into said channel, said blade extending from proximate to said first side of said housing to proximate to said second side of said housing, said blade being transverse to said wall, wherein a blunt end of said blade is positioned in said chamber below said third slot, such that an obscurant layer removed from a ticket contacting said blade is directed into said chamber;

a biaser, said biaser being positioned in said channel and coupled to said wall substantially opposite said third slot, wherein said biaser is positioned on said wall such that a ticket being positioned through said channel is brought into sliding contact with said scraper, said biaser extending from proximate to said first side of said housing to proximate to said second side of said housing, said biaser comprising a protrusion, said protrusion being coupled to said wall substantially opposite said third slot, said protrusion being rounded;

said housing comprising a lower portion and an upper portion, said lower portion being positioned below said second slot, said lower portion being separable from said upper portion, wherein said lower portion is configured to collect debris entering said chamber, and wherein said lower portion is separable from said upper portion such that the debris may be removed from said housing, said upper portion having a lower lip, said lower lip being recessed relative to an exterior of said housing, said lower portion having a upper end, said upper end being open, said upper end being complementary to said lip, wherein said lip is positioned for insertion into said upper end, such that said lower portion is reversibly couplable to said upper portion, and wherein said first slot is configured for insertion of a ticket, wherein said scraper is configured to remove an obscurant layer from the ticket as the ticket is directed past said scraper to said second slot.

* * * * *